US008770835B2

(12) United States Patent
Sroka et al.

(10) Patent No.: US 8,770,835 B2
(45) Date of Patent: Jul. 8, 2014

(54) APPARATUS AND METHODS FOR ESTIMATING A CHARACTERISTIC OF A FLUID DOWNHOLE USING THERMAL PROPERTIES OF THE FLUID

(75) Inventors: Stefan Sroka, Niedersachsen (DE); Peter Schaefer, GroB Kreutz (DE)

(73) Assignee: Baker Hughes Incorporated, Houston, TX (US)

( * ) Notice: Subject to any disclaimer, the term of this patent is extended or adjusted under 35 U.S.C. 154(b) by 410 days.

(21) Appl. No.: 11/867,138

(22) Filed: Oct. 4, 2007

(65) Prior Publication Data

US 2008/0083273 A1 Apr. 10, 2008

Related U.S. Application Data

(60) Provisional application No. 60/849,950, filed on Oct. 6, 2006.

(51) Int. Cl.
*G01N 25/00* (2006.01)
*G01K 13/12* (2006.01)

(52) U.S. Cl.
USPC ..... 374/45; 374/136; 374/141; 374/5; 702/11; 340/853.1; 340/870.17

(58) Field of Classification Search
USPC ..... 374/29, 30, 134–136, 139, 141, 143, 374/43–45, 110, 112, 115, 137, 166, 5; 73/152.01, 152.33, 154; 175/24, 17, 175/20, 40, 50, 78, 171, 308, 315; 166/336, 166/264, 162, 242.1; 340/853.1, 853.3, 340/870.17; 702/6, 9, 11
See application file for complete search history.

(56) References Cited

U.S. PATENT DOCUMENTS

| | | | | | |
|---|---|---|---|---|---|
| 3,011,342 | A | * | 12/1961 | Simm | 73/152.33 |
| 3,864,969 | A | * | 2/1975 | Smith, Jr. | 73/152.13 |
| 3,913,398 | A | * | 10/1975 | Curtis | 73/152.33 |
| 4,575,261 | A | * | 3/1986 | Berger et al. | 374/136 |
| 4,723,066 | A | * | 2/1988 | Kurokawa et al. | 392/448 |
| 5,159,569 | A | * | 10/1992 | Xu et al. | 702/13 |
| 5,163,321 | A | | 11/1992 | Perales | |
| 5,277,495 | A | | 1/1994 | Forehand | |
| 5,348,093 | A | * | 9/1994 | Wood et al. | 166/250.14 |
| 5,428,994 | A | | 7/1995 | Wenzel et al. | |
| 5,610,331 | A | | 3/1997 | Georgi | |

(Continued)

FOREIGN PATENT DOCUMENTS

| | | | |
|---|---|---|---|
| GB | 2350139 | A * | 11/2000 |
| JP | 04189998 | A * | 7/1992 |
| WO | WO02077613 | | 10/2002 |

*Primary Examiner* — Gail Verbitsky
(74) *Attorney, Agent, or Firm* — Cantor Colburn LLP

(57) ABSTRACT

The disclosure provides a system, tools and methods for estimating a property or characteristic of a fluid downhole. In one aspect, the method may include: heating the fluid at a selected or first location during a first time phase, taking temperature measurements of the fluid substantially at the selected location during a second time phase, and estimating the property of the downhole fluid using temperature measurements. Temperature measurements may also be taken at a location spaced apart from the first location and used to estimate the property of the fluid. The tool may include a device that heats the fluid during a first time phase and takes temperature measurements of the fluid during a second time phase. A processor uses the temperature measurements and a model to estimate a property of interest of the fluid.

16 Claims, 4 Drawing Sheets

(56) References Cited

U.S. PATENT DOCUMENTS

| | | | | |
|---|---|---|---|---|
| 5,803,186 | A * | 9/1998 | Berger et al. | 175/50 |
| 6,150,601 | A * | 11/2000 | Schnatzmeyer et al. | 136/201 |
| 6,216,782 | B1 * | 4/2001 | Skinner | 166/250.01 |
| 6,227,045 | B1 * | 5/2001 | Morse et al. | 73/204.22 |
| 6,755,246 | B2 * | 6/2004 | Chen et al. | 166/250.01 |
| 6,789,937 | B2 * | 9/2004 | Haddad et al. | 374/136 |
| 7,086,463 | B2 * | 8/2006 | Ringgenberg et al. | 166/250.01 |
| 7,106,167 | B2 * | 9/2006 | Parsons | 338/25 |
| 7,293,914 | B2 * | 11/2007 | Wang | 374/141 |
| 7,334,637 | B2 * | 2/2008 | Smith, Jr. | 166/288 |
| 7,621,325 | B2 * | 11/2009 | Shammai et al. | 166/264 |
| 2002/0129936 | A1 * | 9/2002 | Cernosek | 166/264 |
| 2003/0126921 | A1 * | 7/2003 | Zisk et al. | 73/152.18 |
| 2003/0205083 | A1 * | 11/2003 | Tubel et al. | 73/152.19 |
| 2004/0006429 | A1 * | 1/2004 | Brown | 702/12 |
| 2004/0244970 | A1 * | 12/2004 | Smith, Jr. | 166/250.01 |
| 2004/0252748 | A1 | 12/2004 | Gleitman | |
| 2005/0028974 | A1 * | 2/2005 | Moody | 166/264 |
| 2005/0217350 | A1 | 10/2005 | Jabusch et al. | |
| 2006/0151178 | A1 * | 7/2006 | Howard et al. | 166/369 |
| 2006/0233217 | A1 * | 10/2006 | Gleitman | 374/131 |
| 2007/0119244 | A1 * | 5/2007 | Goodwin et al. | 73/152.28 |
| 2008/0066534 | A1 * | 3/2008 | Reid et al. | 73/152.11 |
| 2008/0066904 | A1 * | 3/2008 | Van Hal et al. | 166/250.1 |
| 2009/0173494 | A1 * | 7/2009 | Tarvin et al. | 166/250.15 |
| 2009/0288881 | A1 * | 11/2009 | Mullins et al. | 175/50 |

* cited by examiner

APPARATUS AND METHODS FOR ESTIMATING A CHARACTERISTIC OF A FLUID DOWNHOLE USING THERMAL PROPERTIES OF THE FLUID

CROSS REFERENCE TO RELATED APPLICATIONS

This application claims priority from U.S. Provisional Application No. 60/849,950 filed Oct. 6, 2006, which is fully incorporated here by reference.

BACKGROUND OF THE DISCLOSURE

1. Field of the Disclosure

This disclosure relates generally to estimating characteristics of fluids from the measurements of thermal properties of the downhole fluids.

2. Description of the Related Art

Wellbores or boreholes for producing hydrocarbons (such as oil and gas) are drilled using a drill string that includes a tubing made up of jointed tubulars or a continuous coiled tubing and a drilling assembly, also referred to as the bottom hole assembly (BHA), attached to the bottom end of the drill string. The BHA typically includes a number of sensors and tools that are used for evaluating properties of the formation and for drilling directional boreholes. A drill bit attached to the BHA bottom is rotated with a drilling motor in the BHA and/or by rotating the drill string to drill the wellbores. To drill a wellbore, drilling fluid, also referred to as the "mud," is supplied under pressure to the drill string, which mud discharges at the bottom of the drill bit and circulates back to the surface via an annulus between the drill string and the wellbore inside.

A majority of the wellbores are drilled under overbalanced conditions, wherein the pressure on the formation surrounding the wellbore due to the weight of the mud column is greater than the natural or connate pressure of the formation. The drilling mud invades the formation to a certain depth and contaminates the connate fluid (fluid present in the formation under natural conditions). It is desirable to estimate or determine the characteristics or properties of interest of the fluid in the formation during drilling of the wellbore. These estimates can then be used to control drilling of the wellbore and to estimate the presence of hydrocarbons. Formation fluid samples also may be taken during drilling of a wellbore and/or after a well has been drilled. To obtain a relatively clean (substantially free of mud filtrate) fluid sample, the formation fluid is typically pumped into the wellbore until clean or uncontaminated formation fluid starts to flow out of the formation. Invasion is less during drilling of a wellbore compared to the invasions after a few hours after the wellbore has been drilled under overbalanced conditions. It is therefore desirable to determine when the formation fluid being withdrawn is clean so that a formation fluid samples may be taken.

The present disclosure provides a downhole tool and method for estimating certain characteristics of downhole fluids, including estimating the contamination of the fluid.

SUMMARY OF THE DISCLOSURE

The disclosure provides a system, tools and methods for estimating one or more properties or characteristics of a fluid downhole. In one aspect the method includes heating the fluid at a selected location during a first phase; taking a plurality of temperature measurements of the fluid substantially at the selected location during a second phase; and estimating the property of the downhole fluid from the plurality of measurements made during the second phase. The method further may include taking a plurality of temperature measurements at a location spaced apart from the first location during the second phase. The properties of the fluid may include one or more of: a phase change of the fluid; a presence of one or more of oil, gas and water; a proportion of a constituent of the fluid; and contamination level in the fluid. The fluid property, in one aspect, is estimated by using a model that includes information based at least in part on predetermined measurements relating to one or more thermal properties of fluids. The model may use an algorithm for performing calculations; look up tables; thermal profiles; etc. The predetermined measurements may include laboratory measurements for mixtures of oil, water, gas and mud. The plurality of measurements may be taken continuously or periodically over a selected time period defining the second phase. In another aspect, the measurements may be repeated during subsequent phases.

The tool, in one aspect, may include a chamber for holding a fluid withdrawn from a formation and a device that heats the fluid in the chamber at a selected location during a first time period and measures the temperature of the fluid at or substantially at the selected location during a second time period. The device includes a heating element a temperature sensing element. The same element may be used for heating and taking temperature measurements of the fluid. The heating and sensing elements may be located in a common housing.

The apparatus may further include one or more sensors placed spaced apart from the device for taking temperature measurements during a selected phase. The tool further may include a controller that estimates the property of the fluid using the temperature measurements taken by the device. The controller may use a model and the temperature measurement from the device to estimate the property of the fluid. The tool further may include a sealing member that presses against the formation for extracting the fluid from a formation. In one embodiment, the tool includes a pump that pumps the formation fluid from the formation through the sealing member and into the chamber. In one aspect, the tool includes a valve and a discharge line that allows the pumping of the formation fluid into the wellbore. In another embodiment, the tool includes a low pressure collection chamber associated with the chamber containing the device to allow the formation fluid to flow from the formation into the chamber containing the device.

The system, in one aspect, includes a bottomhole assembly (BHA) that carries the tool. The BHA includes a telemetry unit that provides two-way data communication between the tool and a surface controller. The measurements made by the tool may be processed downhole and the results transmitted to the surface controller during drilling of the wellbore. The telemetry unit may utilize a mud pulser for generating mud pulses, an electromagnetic telemetry system or an acoustic telemetry system.

Aspects of the apparatus and methods disclosed herein have been summarized broadly to acquaint the reader with the subject matter of the disclosure only and it is not intended to be used to limit the scope of the concepts, methods or embodiments disclosed herein or any claims that may be made pursuant to this disclosure. An abstract is provided to satisfy certain regulatory requirements and is not to be used to limit the scope of the concepts, methods or embodiments disclosed herein or the claims that may be made pursuant to this disclosure.

BRIEF DESCRIPTION OF THE DRAWINGS

The various features of the disclosure will be better understood from the following detailed description and the drawings, wherein the disclosure is illustrated by way of examples for the purpose of illustration and are not intended to limit the scope of the claims or this disclosure, wherein:

DESCRIPTION OF THE EMBODIMENTS

Figure 1:
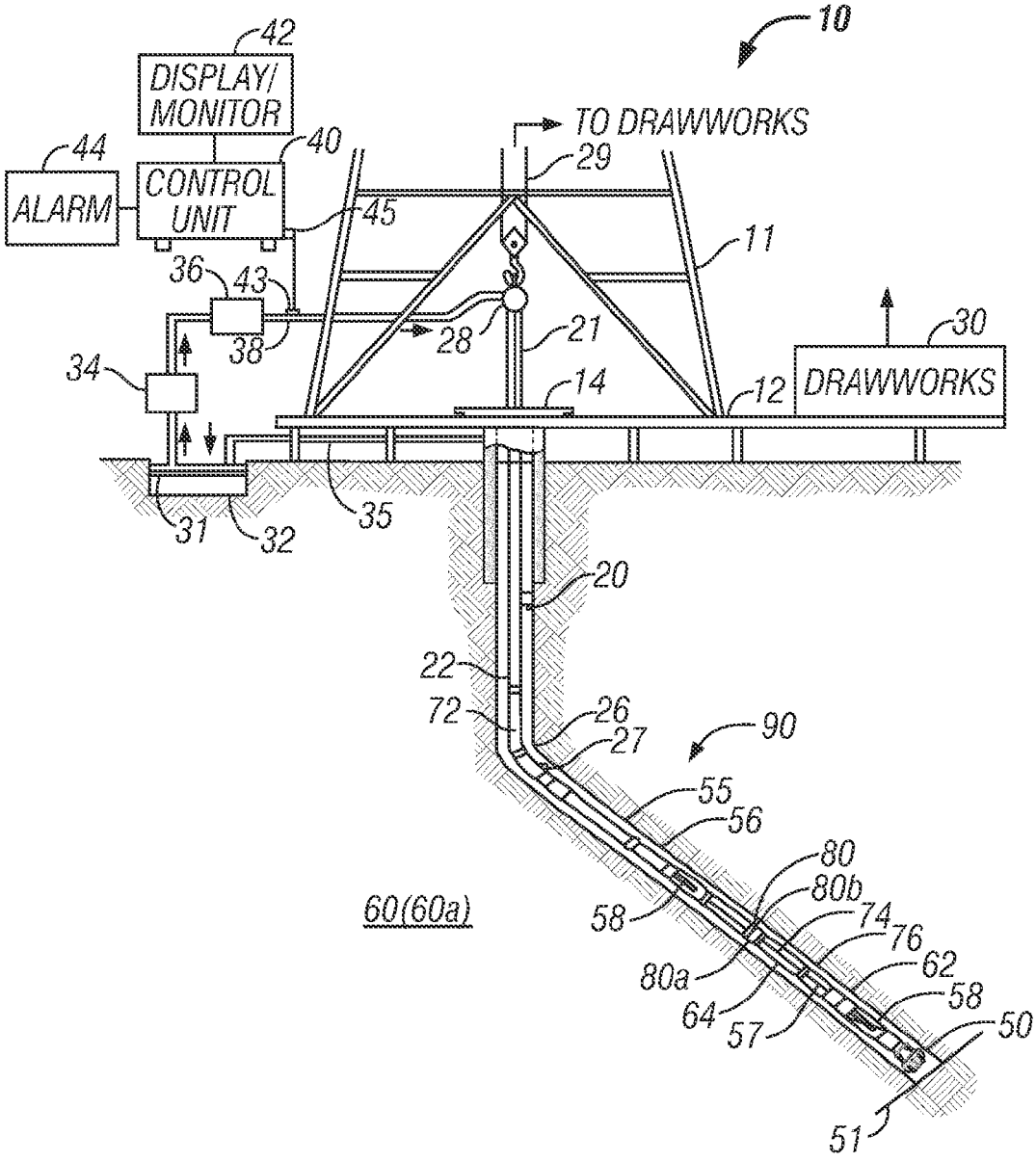
FIG. 1 shows a schematic diagram of a drilling system having a drill string containing a drilling assembly that includes a tool for estimating characteristics of the downhole fluid using measurements of the thermal properties of the downhole fluid according to one embodiment of the disclosure.

FIG. 1 shows a schematic diagram of a drilling system 10 for drilling a wellbore 26 into a formation 60 using a drilling assembly 90 attached to a bottom end of a drill string 20. The drilling system 10 further includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A drill bit 50, attached to the end of the BHA 90, disintegrates the geological formations 60 when the drill bit is rotated to drill the borehole 26. The drill string 20 is coupled to a drawworks 30 via a kelly joint 21, swivel 28 and line 29 through a pulley. During the drilling operations, the drawworks 30 is operated to control the weight on bit ("WOB"), which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and information about other desired parameters relating to the drilling of the wellbore 26.

In some applications the drill bit 50 is rotated by only rotating the drill pipe 22. However, in other applications, a downhole motor 55 (also referred to as the "mud motor") disposed in the drilling assembly 90 is used to rotate the drill bit 50 and/or to superimpose or supplement the rotation of the drill pipe 22. The rate of penetration (ROP) of the drill bit 50 into the borehole 26 for a given formation and a drilling assembly largely depends upon the WOB and the drill bit rotational speed.

In one aspect of the embodiment of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, downthrust of the drilling motor 55, and the reactive upward loading from the applied WOB. One or more stabilizers 58 coupled to the bearing assembly 57 and the drilling assembly act as centralizers for the lowermost portion of the mud motor assembly and other uphole locations.

A surface control unit 40 receives signals from the downhole sensors and devices via a sensor 43 placed in the fluid line 38 and signals from sensors S1, S2, S3, hook load sensor and any other sensors used in the system 10 and processes such signals according to programmed instructions provided to the surface control unit 40. The surface control unit 40 displays desired drilling parameters and other information on a display/monitor 42 that is utilized by an operator to control the drilling operations. The surface control unit 40 may be a computer-based system that contains a computer, data storage device (memory) for storing data, programs, model and algorithms (sometimes individually or collectively referred to herein as "information"), recorder for recording data and other peripherals. The surface control unit 40 also may include a simulation model and process data according to programmed instructions and respond to user commands entered through a suitable device, such as a keyboard. The surface control unit 40 may be adapted to activate alarms 44 when certain unsafe or undesirable operating conditions occur.

Still referring to FIG. 1, BHA 90 also contains certain sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination and azimuth of the BHA 90. A suitable formation resistivity tool 64 may be coupled above a lower kick-off subassembly 62 that provides signals from which resistivity of the formation near or in front of the drill bit 50 may be determined. An inclinometer 74 and gamma ray device 76 are suitably placed along the resistivity measuring device 64 for respectively determining the inclination of the BHA 90 and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. Still referring to FIG. 1, other measurement-while-drilling or logging-while-drilling (LWD) devices, such as devices for measuring formation porosity, permeability and density, may be placed above the mud motor 55 for providing information useful for evaluating the subsurface formations along borehole 26.

The above-noted devices transmit data to a downhole telemetry system 72, which in turn transmits the received data uphole to the surface control unit 40. The downhole telemetry system 72 also receives signals and data from the uphole control unit 40 and transmits such received signals and data to the appropriate downhole devices. In one aspect, a mud pulse telemetry system may be used to communicate data between the downhole sensors and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Any suitable telemetry system may be used for the purpose of this disclosure, including, but not limited to, an electromagnetic telemetry system, an acoustic telemetry system, and a wired pipe system in which a data communication link such as an electrical conductor or optical fibers are placed along the drilling tubulars or in a coiled tubing that conveys the drilling assembly into the wellbore.

The drilling system 10 described thus far relates to those drilling systems that utilize a drill pipe for conveying the drilling assembly 90 into the wellbore 26, wherein the weight on bit is controlled from the surface, typically by controlling the operation of the drawworks. However, drilling systems for drilling highly deviated and horizontal wellbores often utilize coiled-tubing for conveying the drilling assembly into the wellbore. In such systems, a thruster is sometimes deployed in the drill string to provide the desired force on the drill bit. Also, the coiled-tubing is not rotated but injected into the wellbore by a suitable injector and the drill bit 55 is rotated by a downhole motor, such as mud motor 55. For offshore drilling, an offshore rig or a vessel is used to support the drill string.

Still referring to FIG. 1, the BHA 90 further includes a formation testing tool formation testing tool 80 placed at a suitable location in the BHA 90. The formation testing tool 80 includes a device to withdraw fluid 60*a* from the formation 60 into a measurement chamber. Sensors 80*a* and 80*b* in fluid communication with the formation fluid 60*a* in the chamber take temperature measurements of the fluid as described in more detail in reference to FIGS. 2-5. The formation testing tool 80 further includes a controller that has a processor, data storage device, and electronic circuitry for controlling the various operations of the tool 80, and for processing the measurements and estimating a property or characteristic of the formation fluid.

Figure 2:
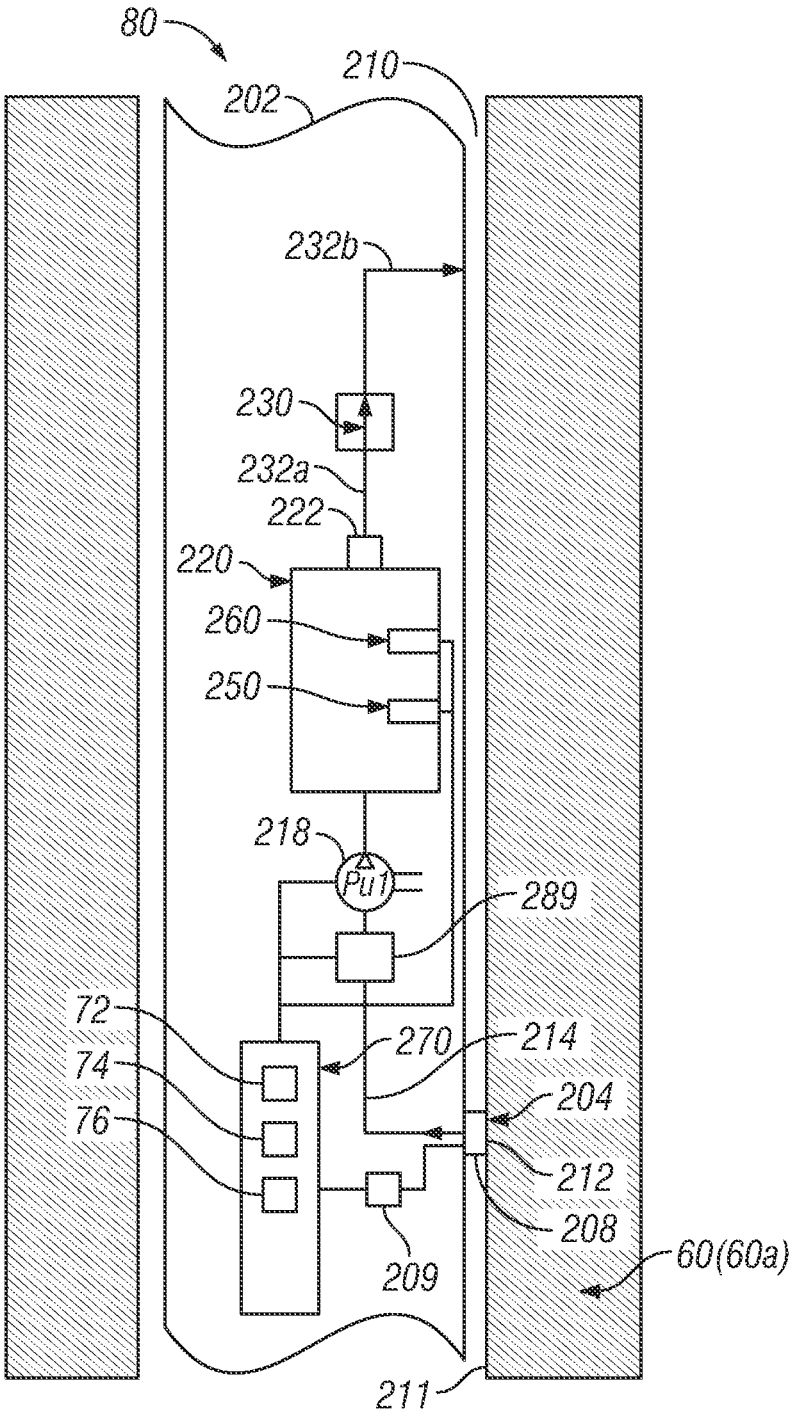
FIG. 2 shows a schematic diagram of a tool placed in a wellbore for taking in-situ measurements of a downhole fluid according to one embodiment of the disclosure.

FIG. 2 shows a schematic diagram of tool 80 placed in a wellbore for taking in-situ measurements of a downhole fluid according to one embodiment of the disclosure. The tool 80 includes a tool body 202 that carries or houses the sensors and a controller. The tool 80 includes a connecting element 204 that in an extended position abuts against the wellbore inside for extracting the formation fluid 60*a* from the formation. The connecting element 204 may include a pad 208 that sealingly presses against the inside wall 211 of the wellbore. The connecting element 204 also may include a probe 212 in the pad that abuts against or penetrates into the formation 60 for withdrawing the formation fluid 60*a*.

The connecting element 204 is in fluid communication with the measurement chamber 220 via a hydraulic line 214. In one aspect, a pump 218 in the hydraulic line 214 pumps the formation fluid 60*a* from the formation 60 into the measurement chamber 220. The measurement chamber 220 may include an exit port 222 so that the fluid from the measurement chamber 220 may be expelled or discharged into the wellbore 210 via a control valve 230 and lines 232*a* and 232*b*. Alternatively, the fluid 60*a* received from the formation may be directly discharged from the pump 218 into the wellbore 210 via another valve and fluid lines (not shown), bypassing the measurement chamber 220. A measuring device or first sensor 250 is placed in fluid communication with the formation fluid in the measurement chamber 220. The device 250 may be disposed inside the measurement chamber 220 or a sensing element of the device may be in contact with the fluid. In one aspect, the device 250 includes a heating element and a sensing element as described in more detail in reference to FIG. 4. One or more additional sensors 260 may also be disposed in fluid communication with the fluid in the measurement chamber 220, spaced apart from the measuring device 250. The one or more additional sensors 260 may be disposed in the measurement chamber 220 or the sensing elements of such additional sensor be placed in fluid communication with the fluid in the measurement chamber 220. A suitable controller or control unit and related circuitry 270 is coupled to the pump 218, each of the sensors 250, 260 and to a force application device 209. The force application device 209 extends the connecting element 204 toward and retracts it from the wellbore wall 211. The control electronics 270 includes a processor 272, such as a micro-processor, memory 274 that stores data, programmed instructions, algorithons and models for use by the processor, circuits 276 to receive input signals from the sensors 250, 260 and circuits to control the operations of the pump 210, valve 230, power device 209 and other electrically controllable elements of the tool 80. The control circuit 270 or any portion thereof may be placed within or outside the tool 80, including the surface. Such a controller or control circuit is known in the art and is therefore not described in detail herein. Therefore, any suitable control circuit may be utilized for the purpose of this disclosure.

To obtain in-situ measurements of the formation fluid 60*a*, the tool 80 in the BHA 90 (FIG. 1) is positioned at a selected depth in the wellbore. The controller 270 causes the connecting element 204 to extend radially outward so that the pad element 208 seals against the wellbore wall 211, allowing the probe 212 to abut or penetrate the formation 60. In one mode of operation, the controller 270 opens the valve 230 and operates the pump 218 to pump the formation fluid 66*a* from the formation 60 into the wellbore 210. A device, such as an optical device or another sensor 289 may be used to monitor the contamination level (due to mud filtrates in the formation fluid) in the fluid. The fluid may be pumped into the wellbore 210 for a predetermined period of time so as to obtain a relatively clean or connate fluid, as indicated by the sensor 289. The valve 230 is then closed to trap a sample of the formation fluid in the measurement chamber 220.

Figure 3:
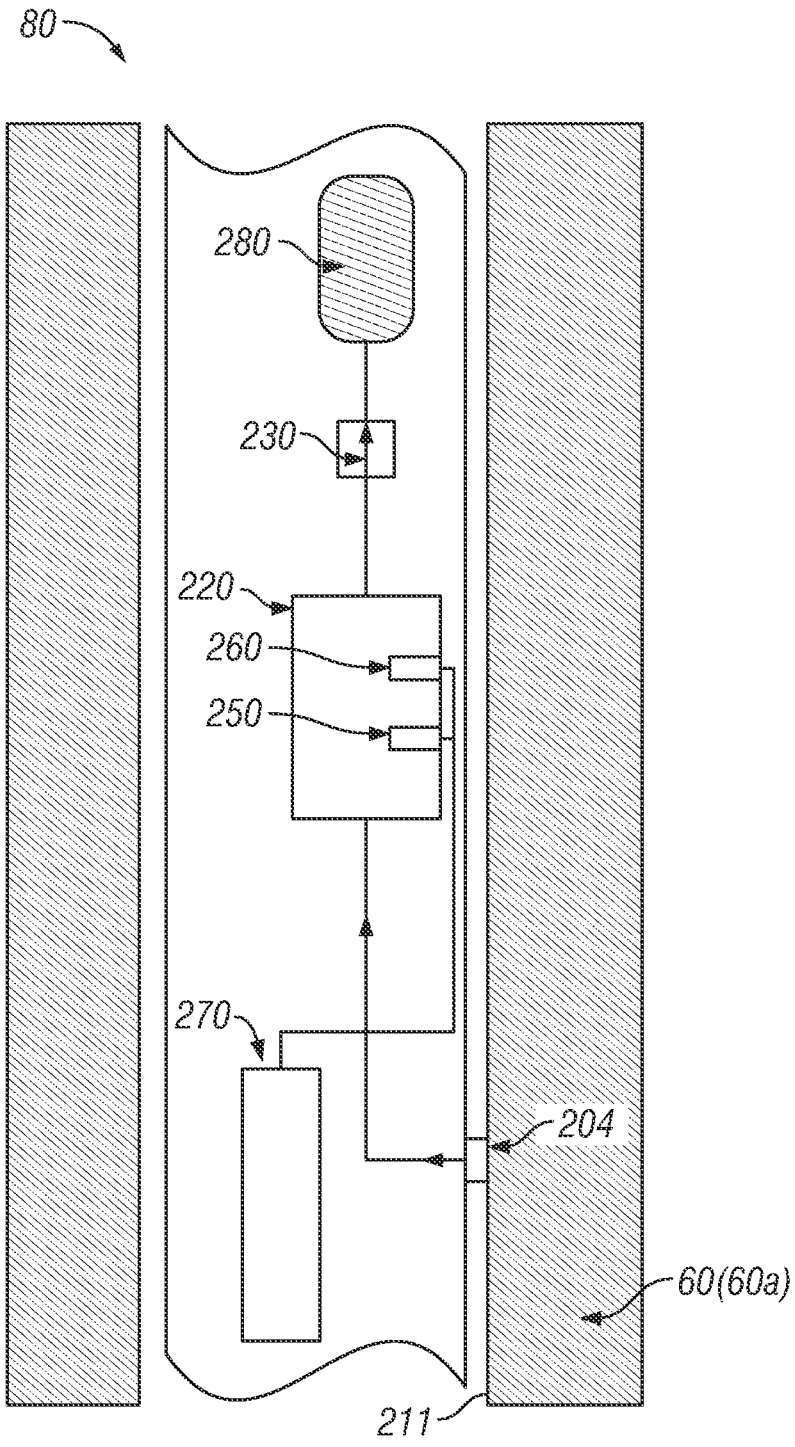
FIG. 3 shows a schematic of a tool placed in a wellbore for taking in-situ measurements of the downhole fluid, according to another embodiment of the disclosure.

FIG. 3 shows an alternative configuration or embodiment of the tool 80. In the configuration of FIG. 3, a low pressure chamber 280 is used to withdraw the formation fluid 60*a* from the formation 60. In operation, the controller 270 sets the connecting element 204 against the formation 60 and opens the valve 230. The inside pressure of the chamber is set at the surface at a level below the formation pressure. When the valve 230 is opened, the pressure differential between the formation 60 and the internal pressure of the chamber 280 enables the formation fluid 60*a* to pass to the chamber 280. Once the chamber 280 is filled, the controller 270 operates the sensors 250 and 260 to take the measurements and to provide an estimate of one or more characteristics or parameters of the formation fluid as described in more detail in reference to FIGS. 4-5.

Figure 4:
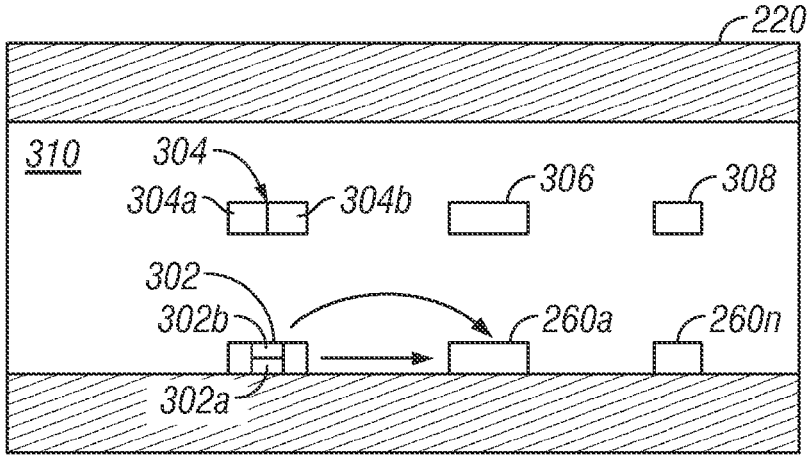
FIG. 4 shows an embodiment for the placement of sensors in a downhole tool, including the tools shown in FIGS. 2-3, for taking measurements of the downhole fluid according to one embodiment of the disclosure.

FIG. 4 shows one arrangement for the placement and operation of the measuring device 250 alone and also when the device 250 is used in conjunction with one or more additional sensors, such as sensors 260*a* and 260*n*. As noted earlier, in one aspect, the measuring device 250 may include a heating element or heater 302*a* and a sensing element or sensor 302*b*. The controller 270 (FIG. 2), in one aspect, controls the energy supply to the heat element 302*a* to control the heating temperature of the heat element 302*a*. The heat element heats the fluid 310 surrounding the element 302*a*.

The sensing element 302*b* takes measurements, such as temperature measurements, of the fluid 310 surrounding the element 302*b*. The heating element 302*a* and the sensing element 302*b* may the same element 302. Alternatively, the sensing element 302*b* may be coupled to or placed close to the heating element 302*a*. In another embodiment, the device may include a separate heater unit and a separate sensor. The heater and the sensor may be located in a common housing and may be electrically separated. The heater and the sensor may also be controlled or operated by common or different processors or may employ common or separate electronic circuitry.

Still referring to FIG. 4, in operation, once the fluid sample 310 is placed in the chamber 220, current is passed to the heating element 302*a* for a selected time period to heat the fluid 310 adjacent the heating element 302*a* (first phase or the heating phase). In the heating phase, the element 302*a* acts as a heat source, raising the temperature of the fluid 310 by dissipating heat to the fluid 310. In a subsequent phase (the sensing phase), the sensor 302*b* measures the temperature at or substantially at the same position as that of the heat source 302*a*. The controller 270 may monitor the temperature of the fluid 310 in the sensing phase continuously or periodically. The temperature change over time (after terminating the heat source) will depend on the heat capacity and heat flow characteristics (convection, conductance, medium transport) of the fluid 310, i.e., the thermal characteristics of the fluid 310. The system shown in FIG. 4 may be operated when the fluid 310 is still or when it is fluxionary or flowing. The heat generated by the heat element 302*a* also conducts toward the sensors 260*a* and 260*n*, which sensors may be utilized to measure the change in temperatures of the fluid 310 at their respective locations.

Figure 5:
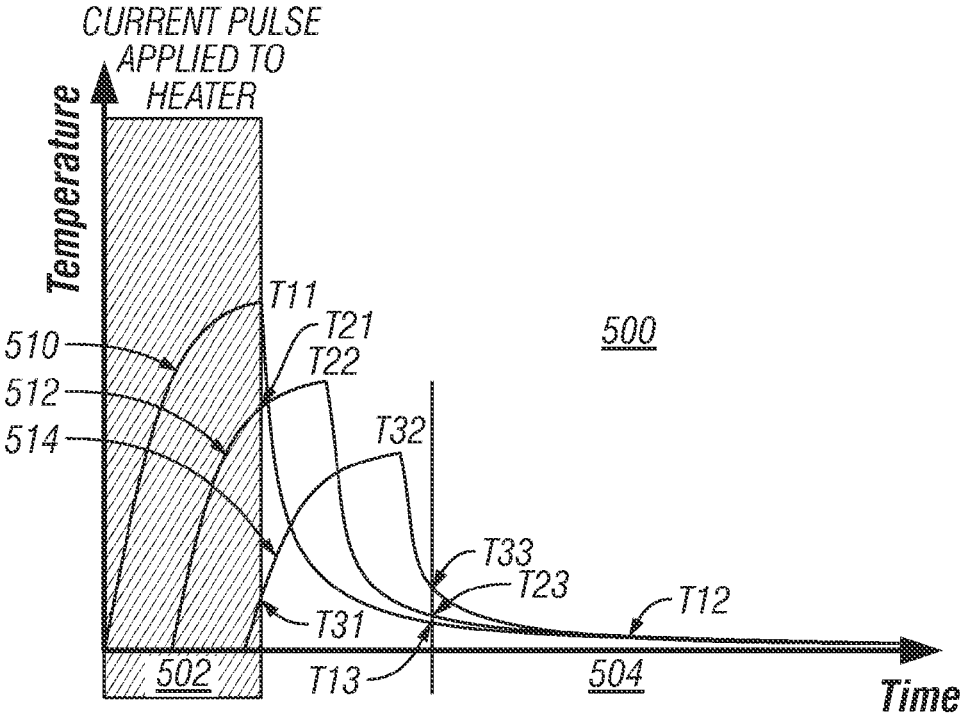
FIG. 5 shows a graph depicting various temperature profiles corresponding to the sensors shown in FIG. 4.

FIG. 5 depicts a graphical representation 500 of temperature profiles of various sensors shown in FIG. 4. As shown, curve 510 depicts a hypothetical temperature profile (a temperature versus time curve) of the fluid 310 measured by the measurement device 302 during a heating phase 502 followed by a sensing phase 504. As shown in FIG. 5, during the heating phase 502, temperature of the element 302 rises to a temperature $T_{11}$, which may be a stable temperature achieved after the heat source has been activated for a certain time period. The controller 270 controls the current supplied to the element 302 and it may utilize a feedback circuit to control the current supply to heat the fluid to a desired temperature. In the sensing phase 504, the temperature of the heat element 302 (and thus the fluid 310 contacting the sensor) starts to decrease and tends to stabilize at a temperature $T_{12}$ after a certain period of time, which temperature is the normal temperature of the fluid. In one aspect, the controller 270 compares the temperature profile or thermal characteristics of the measurements with a model stored in a memory in the downhole and estimates therefrom a characteristic or property of interest of the fluid 310 in the chamber 220. These characteristics may include the amount of sample cleanup (contamination in the sample); the presence of oil, gas and/or water; and an estimate of the proportions of the constituents of the fluid 310. In one aspect, the model or models for the characteristics of the downhole fluids may be formulated at the surface using generally known thermal properties of various fluids and/or by using measurements made on known fluids, such as fluid samples obtained from downhole formations, fluid mixtures prepared at the surface, such as by mixing crude oils with drilling fluids, etc. The model or models may be provided in any useful form, including, but not limited to, look-up tables, graphs, algorithms and one or more equations. The model or models, in one aspect, may be stored in a data storage device accessible to the processor 270 in the tool. In another aspect, a part or the entire model may be stored in a data storage device accessible to the surface controller 40. In one aspect, the controller 270 may utilize the measurements made by the sensor downhole and the model or models to estimate one or more characteristics of the fluid downhole and send the estimated results to the surface via the telemetry unit 72 (FIG. 1). In another aspect, the controller may partially process the measurement data and send the processed data to the surface or send all of the measurement data to the surface for estimating the fluid characteristics. The estimated values of the fluid characteristics may be displayed on a suitable display at the surface, recorded in a suitable storage medium in a downhole an/or or surface data storage device and/or transmitted to a remote location for analysis, for monitoring the tool operations and for obtaining the formation fluid samples.

Still referring to FIGS. 4 and 5, additional sensors, such as sensors 260*a* to 260*n* may be placed spaced apart from each other and from the sensor 250. Each such sensor may measure the temperature of the fluid in the heating and sensing phases. FIG. 5 shows a hypothetical temperature profiles $T_{21}$, $T_{22}$ and $T_{23}$ for sensor 260*a* and $T_{31}$, $T_{32}$, and $T_{33}$ for sensor 260*n*. Although these profiles are shown to have different high temperatures $T_{21}$ and $T_{31}$ respectively at their transition points from the heating phase to the sensing phase, the gap may become narrower or become negligible based on the length of the heating phase and the distance between the sensors 260*a* and 260*n*. In each case, however, the temperature profile will depend upon the time, distance, and the thermal characteristics of the fluid (heat capacity, convection, conductance and medium transport). One or more models may be used to estimate a property of the downhole fluid 310 using the temperature profiles of sensors 260*a* and 260*n* alone, in combination with one another, and/or in combination with one or more other sensors. Thus, by measuring or monitoring change in temperature of the downhole fluid, one or more properties or characteristics of the downhole fluid may be estimated or monitored using a model as described above. The characteristics may include, but are not limited to, phase changes (from one fluid type to another), contamination level, etc. The measured temperatures or semi-processed data may be sent to the surface controller 40 to further process such information to estimate the downhole fluid characteristics. Although the heater 302*a* and sensors 302*b*, 260*a* and 260*n* are shown placed along a wall of the chamber 220, such devices may be placed at any other suitable locations in the chamber. For example, as shown in FIG. 4, separate heating element 304*a* and temperature sensor 304*b* or in a common package 304 may be deployed along a center axis of the chamber with the other temperature sensors 306 and 308 placed spaced apart from the sensors 304*a* and 304*b* along the same axis or at another suitable location in the chamber. The placement of such devices, amount of heat induced in the fluid and the time phase lengths are design choices based on a particular embodiment chosen and the intended application.

Thus, the disclosure provides a system, apparatus and methods for estimating properties of interest of a fluid downhole. In one aspect, a method includes: heating the fluid downhole at a selected location during a first time phase; taking a plurality of temperature measurements of the fluid substantially at the selected location during a second time phase; and estimating the property of interest of the fluid from the plurality of temperature measurements taken during the second time phase. The property of interest of the fluid may be a phase change of the fluid, a proportion of a constituent of the fluid, a contamination level in the fluid and/or presence of one or more of oil, gas and water. In another aspect, the method may further include: taking a plurality of temperature measurements of the fluid at a location spaced apart from the selected location; and using the temperature measurements taken at the spaced apart location to estimate the property of interest of the fluid. The method, in another aspect, may include: providing a model relating to the property of interest of the fluid; and estimating the property of the fluid using the model and the plurality of temperature measurements taken at the selected location. The model may be based on one or more thermal properties of known fluids. Heating the fluid and taking the plurality of temperature measurements may be taken in a chamber deployed in a wellbore, which chamber receives the fluid while it is being extracted from the formation.

In another aspect, an apparatus made according to one embodiment, may include: a chamber for holding the fluid downhole; and a device that heats the fluid in the chamber at a selected location during a first time phase and measures the temperature of the fluid substantially at the selected location during a second time phase. The apparatus may further include a controller that processes the temperature measurements made by the device to estimate the property of interest of the fluid. The controller, in one aspect, utilizes one or more models stored in a suitable data storage device, to estimate the properties of interest of the fluid. The device, in one aspect, may include a heating element and a temperature sensing element. The heating and temperature measuring elements may be the same. In another aspect, the apparatus may further include one or more sensors that are placed spaced apart from each other and the device for measuring temperature of the fluid at their respective locations during selected time periods. The controller may utilize the measurements made by such sensors to estimate the properties of interest of the fluid. The apparatus may further include a probe configured to abut against a formation in a wellbore for conveying the fluid from the formation into the chamber. A pump or low pressure chamber may be used to cause the fluid to flow from a formation into the chamber. The apparatus may be configured for use during drilling of a wellbore or a wireline tool for use after the drilling of the wellbore.

While the foregoing disclosure is directed to the described embodiments of the disclosure, various modifications will be apparent to those skilled in the art. It is intended that all such variations are considered as part of the inventive concept described here.

What is claimed is:

1. A method for estimating a property of interest of a fluid, comprising:

deploying a chamber into a wellbore;

obtaining a fluid from a formation into the chamber;

heating the fluid at a selected location in the chamber to a selected temperature during a heating phase using an element at the selected location;

taking a plurality of temperature measurements of the fluid using the element at the selected location in the chamber during a sensing phase that follows the heating phase;

taking a plurality of temperature measurements of the fluid at a location spaced apart from the selected location during the sensing phase; and estimating the property of the fluid from the plurality of temperature measurements taken during the sensing phase at the selected location and the spaced apart locations.

2. The method of claim 1, wherein the property of the fluid is one of: a phase change of the fluid; a proportion of a constituent of the fluid; a contamination level in the fluid; and a presence of one or more of oil, gas and water.

3. The method of claim 1, wherein estimating the property of the fluid from the plurality of temperature measurements further comprises:

providing a model relating to the property of the fluid; and estimating the property of the fluid using the model and the plurality of temperature measurements taken at the selected location.

4. The method of claim 3, wherein the model is based at least in part on thermal properties of known fluids.

5. The method of claim 1, wherein the heating phase and sensing phase constitute substantially consecutive time periods.

6. The method of claim 1 further comprising extracting the fluid from the formation, pumping the fluid into the wellbore for a selected period of time, and then supplying the extracted fluid to the chamber.

7. An apparatus for estimating a property of a fluid, comprising:

a chamber configured to be deployed into a wellbore for holding a fluid extracted from a formation; and a device including an element that heats the fluid in the chamber to a selected temperature at a selected location during a heating phase and measures the temperature of the fluid substantially at the selected location during a sensing phase that follows the heating phase and at least one additional temperature sensor at a location spaced apart from the selected location configured to take a plurality of temperature measurements of the fluid during the sensing phase; and a controller that processes the temperatures measurements made at the selected location and the spaced apart location to estimate the property of the fluid.

8. The apparatus of claim 7, wherein the controller uses a model and the temperature measurements to estimate the property of the fluid.

9. The apparatus of claim 7, wherein the device includes a heating element and a temperature sensing element.

10. The apparatus of claim 7 further comprising a sensor placed spaced apart from the device for measuring temperature of the fluid during a selected time period.

11. The apparatus of claim 7 further comprising a probe configured to abut the formation in a wellbore for conveying the fluid from the formation into the chamber.

12. The apparatus of claim 11 further comprising one of a pump and a low pressure chamber to cause the fluid to flow from the formation into the chamber, wherein the low pressure chamber has less pressure than the formation.

13. The apparatus of claim 7 further comprising a conveying member configured to convey the chamber and the device into a wellbore during one of: drilling of a wellbore and after drilling of the wellbore.

14. The apparatus of claim 7, wherein the property of the fluid is one of: a phase change relating to the fluid; a presence of one or more of oil, gas, water and contamination; a proportion of a constituent of the fluid; and a contamination level in the fluid.

15. A wellbore system for estimating a property of interest of a fluid during extraction of the fluid from a formation surrounding a wellbore, comprising:

a tool configured to be deployed into a wellbore that includes:

a chamber for receiving the fluid extracted from the formation;

a heat element that heats the fluid to a selected temperature during a heating period;

a temperature sensor element that measures the temperature of the fluid during a sensing period that following the heating period, wherein the heat element and the temperature sensor element are a single element;

at least one additional temperature sensor at a location spaced apart from the selected location that measurements the temperature of the fluid at the spaced apart location during the sensing period;

a data storage device that stores a model relating to the property of the fluid; and a processor that utilizes the measurements made by the temperature sensor at the selected location and by the at least one additional temperature sensor at the spaced apart location and the model to estimate the property of interest of the fluid during the extraction of the fluid from the formation.

16. The system of claim 15 further comprising:

a drilling assembly that carries the tool and a drill bit an end thereof for drilling the wellbore; and a conveying member that conveys the drilling assembly into the wellbore.

* * * * *